US006464041B1

(12) United States Patent
Chen

(10) Patent No.: US 6,464,041 B1
(45) Date of Patent: Oct. 15, 2002

(54) EMERGENCY LIFTING OR LOWERING DEVICE OF AN ELEVATOR

(76) Inventor: Yung-Hsin Chen, No. 31, Avenue 2, Lane 279, Chung Cheng Road, Yung Kang City, Tainan Hsien (TW)

( * ) Notice: Subject to any disclaimer, the term of this patent is extended or adjusted under 35 U.S.C. 154(b) by 28 days.

(21) Appl. No.: 09/835,333

(22) Filed: Apr. 17, 2001

(51) Int. Cl.[7] ..... B66B 5/02; B66B 1/40; B66B 11/06

(52) U.S. Cl. ..... 187/290; 187/291; 187/298; 187/306; 187/259

(58) Field of Search ..... 187/259, 256, 187/262, 263, 290, 291, 298, 306; 254/284, 285, 290, 292

(56) References Cited

U.S. PATENT DOCUMENTS

| | | | | | |
|---|---|---|---|---|---|
| 275,179 | A | * | 4/1883 | Field | 187/298 |
| 571,502 | A | * | 11/1896 | Wilson | 187/298 |
| 651,672 | A | * | 6/1900 | See | 187/298 |
| 1,066,678 | A | * | 7/1913 | Sundh | 187/298 |
| 4,533,021 | A | * | 8/1985 | Orden | 187/290 |
| 4,592,450 | A | * | 6/1986 | Schaffer | 187/263 X |
| 5,680,911 | A | * | 10/1997 | Wang | 187/263 |

FOREIGN PATENT DOCUMENTS

| | | | | |
|---|---|---|---|---|
| FR | 2644150 A3 | * | 9/1990 | 187/290 |
| JP | 1-271383 A | * | 10/1989 | 187/290 |
| JP | 3-133888 A | * | 6/1991 | 187/298 |

* cited by examiner

*Primary Examiner*—Eileen D. Lillis
*Assistant Examiner*—Thuy V. Tran
(74) *Attorney, Agent, or Firm*—Rosenberg, Klein & Lee

(57) ABSTRACT

An emergency lifting or lowering device of an elevator includes a transmission toothed wheel fitted to a top of a passage receiving a carriage of the elevator. The transmission wheel has teeth locking into an adjacent one of several toothed wheels arranged in a low. The toothed wheels are each associated with a reeling member having first end portions of steel ropes of the elevator wound therearound. The emergency lifting or lowering device further has an emergency switch disposed in the carriage member, and electrically connected to an emergency power to activate the transmission wheel in order to lift or lower the carriage member to a nearest floor when a main motor of the elevator stops due to power failure.

4 Claims, 3 Drawing Sheets

EMERGENCY LIFTING OR LOWERING DEVICE OF AN ELEVATOR

BACKGROUND OF THE INVENTION

The present invention relates to an emergency lifting or lowering device of an elevator which can help the carriage member of the elevator to move up or down to a nearest floor of the building in case of breakdown or power failure.

Referring to FIG. 5, a conventional elevator has a carriage member 1, steel ropes 2, a main motor 3 and a balance weight 4.

The carriage member 1 is received in a longitudinal passage of the building, and has wheels 11 and 12 fitted to a top side.

The steel ropes 2 are passed under the wheels 11 and 12, and connected to a top of the passage of the building from a fixed end portion 121. The steel ropes 2 are passed around the main motor 3 fitted to the top of the passage, and connected to the balance weight 4 from other end portion.

Thus, the carriage member 1 can be moved to a desired floor by means of the motor 3.

However, the motor 3 will stop running to prevent the carriage member 1 from moving up or falling down in case of power failure or breakdown. Consequently, the carriage member 1 stops between two adjacent floors, and the passengers can't get off same safely until the breakdown or the power failure is handled; i.e. the passengers usually have to wait a relatively long time to get off in case of the breakdown or power failure.

SUMMARY OF THE INVENTION

Therefore it is a main object of the present invention to provide an emergency lifting or lowering device for an elevator such that the carriage member of the elevator can be moved up or down to a nearest floor for the passengers to get off the elevator immediately after a breakdown or power failure.

The emergency lifting or lowering device of an elevator of the present invention includes a power supply member, several toothed wheels and an emergency switch.

The power supply member is fitted to a top of the elevator passage provided for receiving the carriage member of the elevator. The power supply member is associated with a transmission toothed wheel.

The toothed wheels each has teeth locking into teeth of adjacent one of the toothed wheels. A first one of the toothed wheels is locked into teeth of the transmission wheel of the power supply member. The toothed wheels are each associated with a reeling member with first end portions of the hoisting steel ropes of the elevator wound therearound.

The emergency switch is disposed in the carriage member of the elevator, and electrically connected to an emergency power supply and the transmission toothed wheel for permitting the transmission toothed wheel to be activated to lift or lower the carriage member to a nearest floor of the building by means of turning the toothed wheel of the reeling member when a main motor of the elevator stops due to power failure or breakdown.

BRIEF DESCRIPTION OF THE DRAWINGS

This invention will be better understood by referring to the accompanying drawings, wherein.

DETAILED DESCRIPTION OF THE PREFERRED EMBODIMENT

Figure 1:
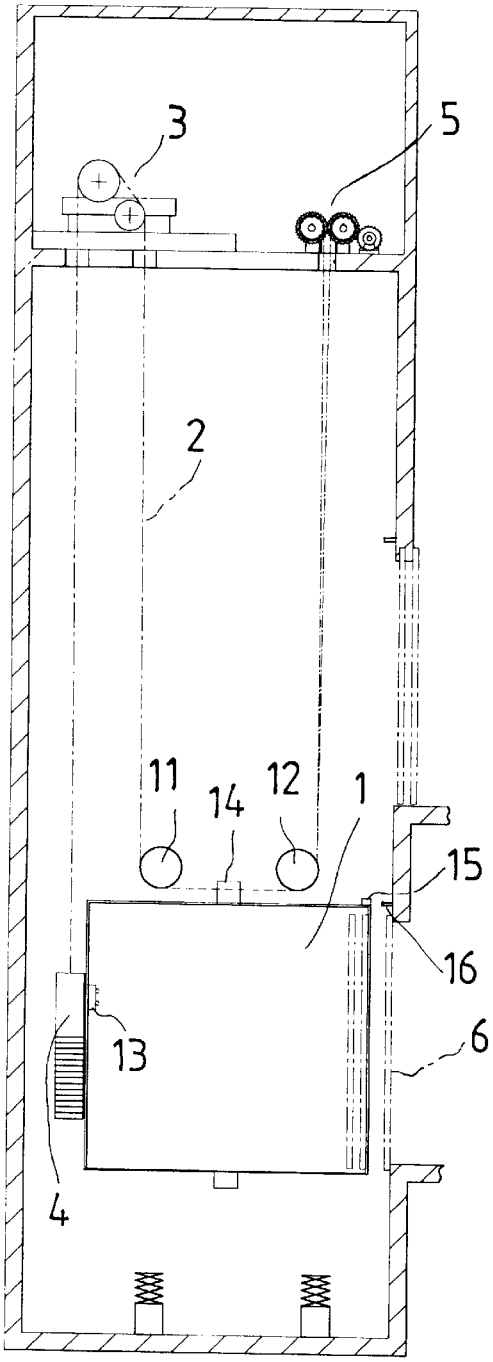
FIG. 1 is a plan view of an elevator with the emergency lifting or lowering device according to the present invention.
Figure 4:
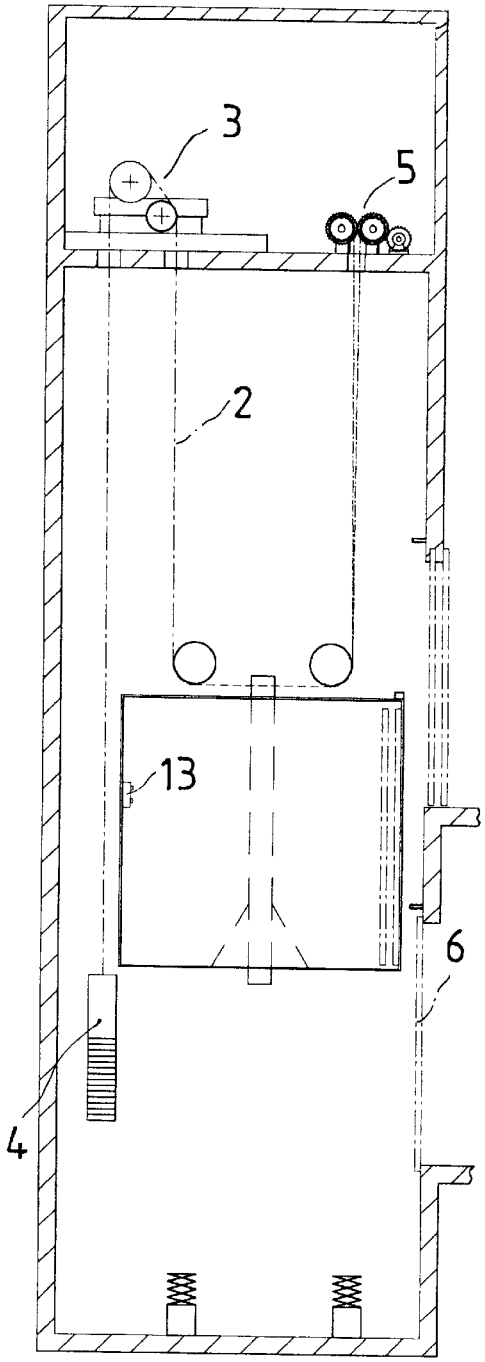
FIG. 4 is a plan view of an elevator with the emergency lifting or lowering device of the present invention under emergency movement.

Referring to FIG. 1, an elevator of the present invention includes a longitudinal passage, a carriage member 1, steel ropes 2, a main motor 3, a balance weight 4 and an emergency lifting or lowering device 5.

The carriage member 1 is movably received in the longitudinal passage, and has wheels 11 and 12 fitted to a top side. The main motor 3 is fixed to a top of the passage. The steel ropes 2 are passed under the wheels 11 and 12, and are connected to the main motor 3 and the balance weight 4 from a rear end portion.

Figure 2:
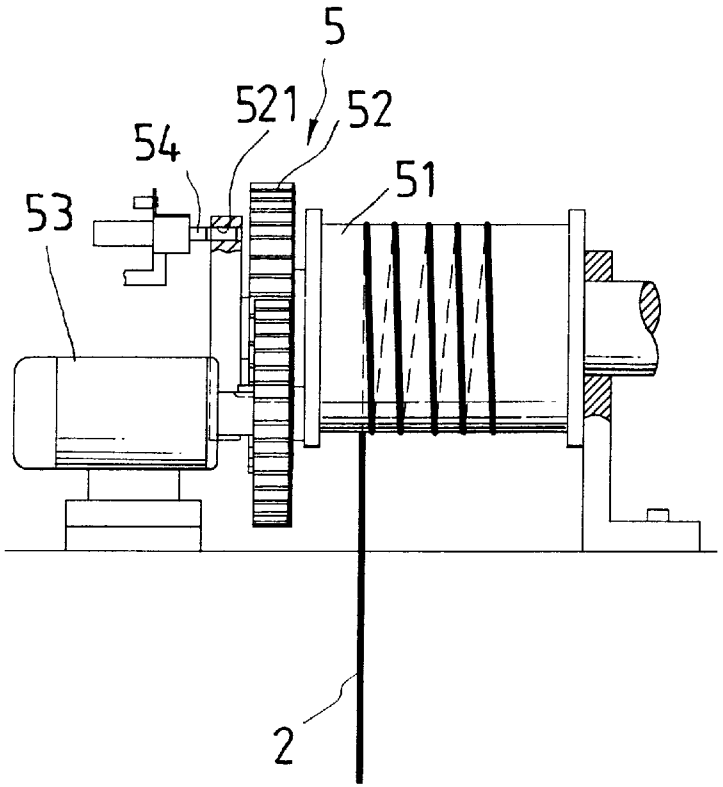
FIG. 2 is a front view of the emergency lifting or lowering device of the present invention.
Figure 3:
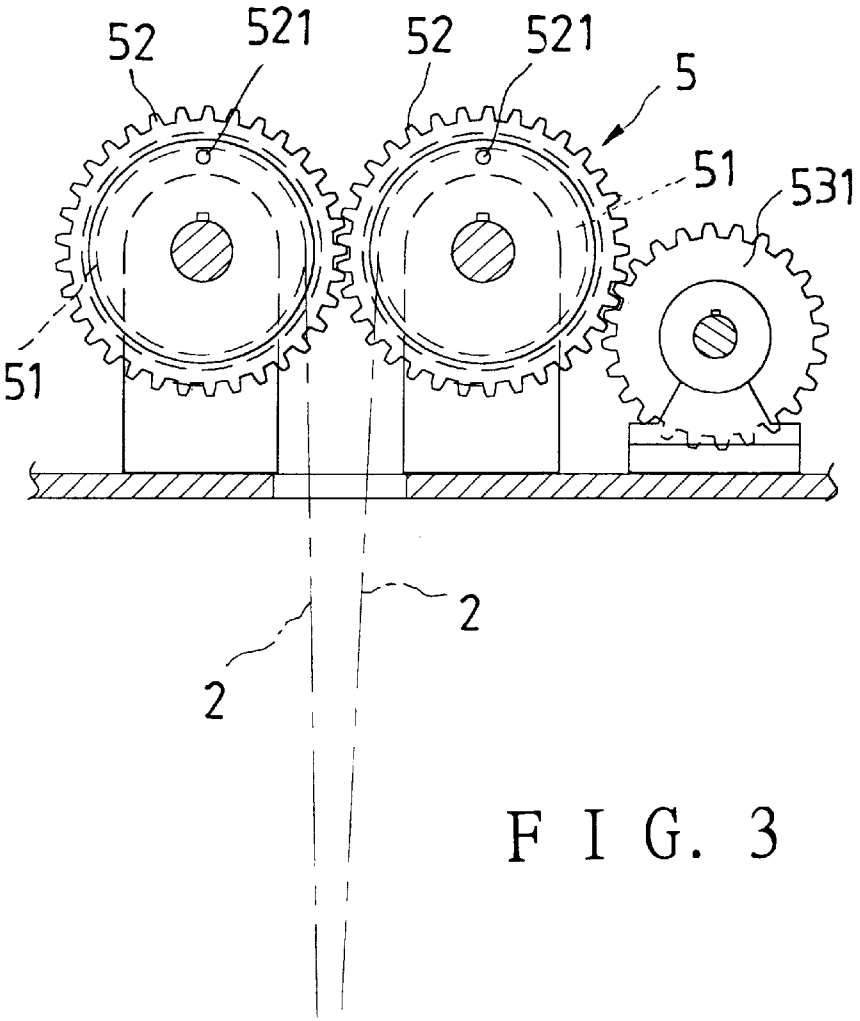
FIG. 3 is a side view of the emergency lifting or lowering device of the present invention.
Figure 5:
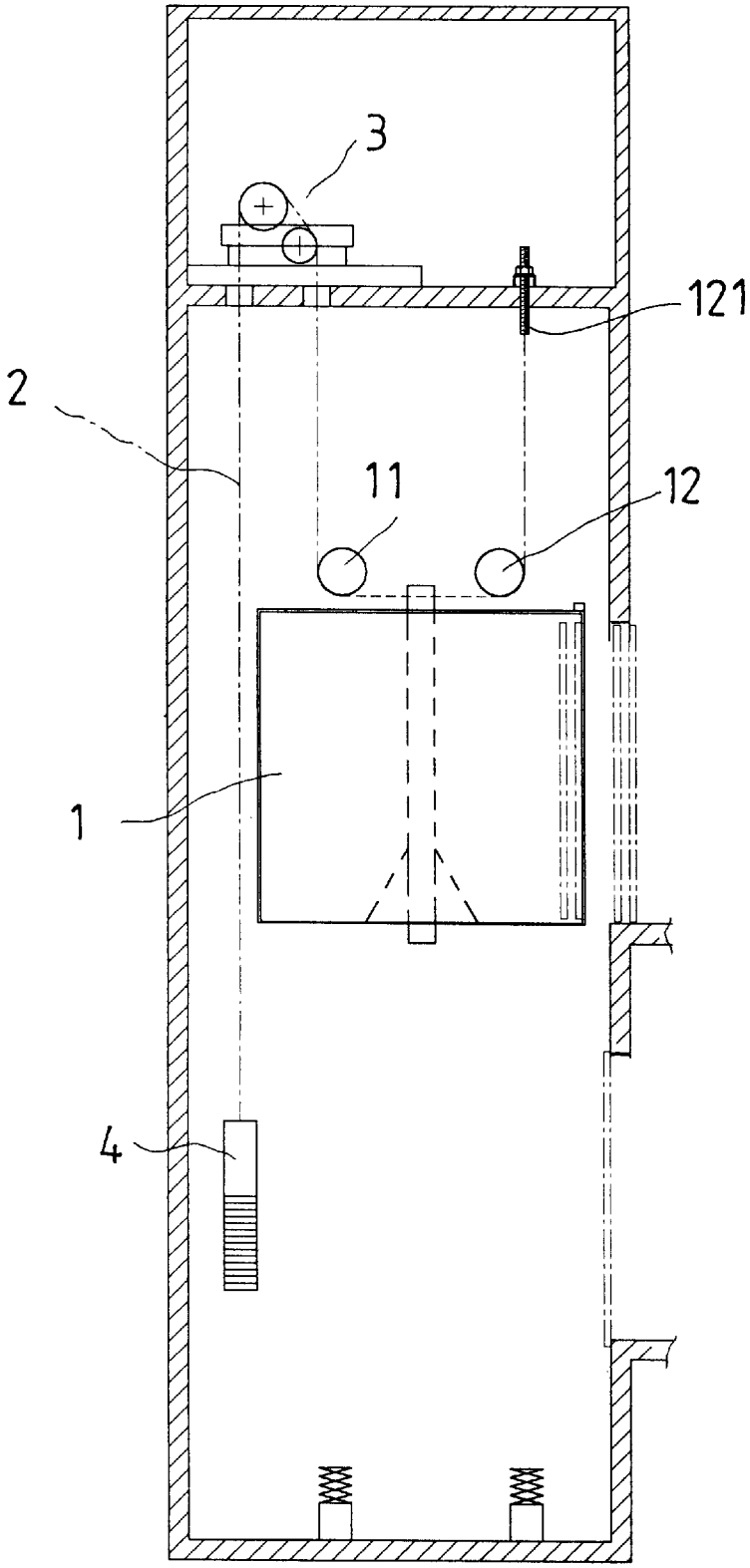
F I G. 5 (PRIOR ART)
FIG. 5 is a plan view of a conventional elevator in the Background.

The emergency lifting or lowering device 5 is disposed on the top of the longitudinal passage. Referring to FIGS. 2 and 3, the emergency lifting or lowering device 5 has two toothed wheels 52 each connected with a reeling member 51; the toothed wheels 52 are disposed such that the teeth of one of the toothed wheels 52 lock into the teeth of the other for the wheels 52 to transfer motion. The emergency lifting or lowering device 5 has a power supply member 53 associated with a transmission toothed wheel 531; the teeth of the transmission toothed wheel 531 locks into those of an adjacent one of the toothed wheels 52.

The steel ropes 2 are connected to, and wound around the reeling members 51 of the emergency lifting or lowering device 5 from the other end; the part of each of the steel ropes 2 which is wound around the reeling member 51 has to be at least no shorter than the distance between two adjacent floors. The toothed wheels 52 each further has a locating hole 521. Safety rods 54 controllable with electromagnetic valves are provided to the emergency lifting or lowering device 5, each being separably passed into a respective one of the locating holes 521 of the toothed wheels 52.

Moreover, an emergency switch 13 is disposed in the carriage member 1, and electrically connected to an emergency power supply 14 fitted to the carriage member 1. The emergency switch 13 is also electrically connected to the lifting or lowering device 5.

A sensor 15 is fitted to a front uppermost part of the carriage member 1, and electrically connected to the lifting or lowering device 5. And, sensor's targets 16 are fitted to an inner side of the passage, each located slightly higher than a respective one of the elevator doors 6 such that the carriage member 1 can stop at an appropriate position for the passengers to get off same easily when the lifting or lowering device is used in case of emergency.

When the elevator is used in normal condition, the safety rods 54 are inserted into the locating holes 521 of the toothed wheels 52 to prevent the wheels 52 from turning. And, the main motor 3 and the steel ropes 2 move the carriage member 1 to desired floors.

In case of breakdown or power failure, the main motor 3 stops running immediately to prevent the carriage member 1 from moving up or falling down. The passengers pull the emergency switch 13 to activate the electromagnetic valves for the safety rods 54 to move out of the locating holes 521, and also activate the power supply member 53 of the emergency lifting or lowering device 5. Thus, the toothed wheels 52 become turnable for the carriage member 1 to move upwards or downwards; the power supply member 53 helps the toothed wheels 52 to reduce the turning speed in order to slow down the carriage member 1. When the sensor 15 meets a first one of the sensor's targets 16, the power supply member 53 will stop to prevent the carriage member 1 from moving further. Thus, the carriage member 1 is moved up or down to a nearest floor for permitting the passengers to get off the elevator safely and quickly.

After the breakdown (or power failure) is handled, the steel ropes 2 can be wound back around the reeling members 51 by means of the power supply member 53, and the safety rods 54 inserted into the locating holes 521 of the toothed wheels to keep the emergency lifting or lowering device 5 on standby.

From the above description, the emergency lifting or lowering device of an elevator of the present invention can be known to have advantage that the carriage member can be lifted or lowered to a nearest floor exactly and quickly after a breakdown (or power failure) such that the passengers can get off the elevator quickly without having to suffer from waiting a long time.

What is claimed is:

1. An emergency lifting or lowering device of an elevator, comprising a power supply member fitted to a top of a passage provided for receiving a carriage member of said elevator; said power supply member being associated with a transmission toothed wheel;

a plurality of toothed wheels; said toothed wheels each having teeth locking into teeth of adjacent ones of said toothed wheels; a first one of said toothed wheels being locked into teeth of said transmission toothed wheel of said power supply member from teeth thereof; said toothed wheels being each associated with a reeling member with first end portions of steel ropes of said elevator wound therearound;

an emergency switch disposed in said carriage member of said elevator; said emergency switch being electrically connected to both an emergency power supply and said power supply member for permitting said power supply member to be activated to lift or lower said carriage member to a nearest floor by means of turning said toothed wheels when a main motor of said elevator stops due to power failure.

2. The emergency lifting or lowering device of an elevator as claimed in claim 1, wherein said toothed wheels each has a locating hole, and said lifting or lowering device has safety rods each reparably passed into a respective one of said locating holes; said safety rods being moved out of said locating holes of said toothed wheels for permitting said toothed wheels to turn to lift or lower said carriage member of said elevator when said emergency switch is pulled in emergency.

3. The emergency lifting or lowering device of an elevator as claimed in claim 1, wherein a sensor is fitted to a front uppermost part of said carriage member, and electrically connected to said lifting or lowering device; said passage of said elevator being provided with sensor's targets each positioned on a top of a respective one of doors of said elevator passage for permitting said carriage member to move up or down to stop at a position as high as a nearest floor when said sensor meets one of said sensor's targets.

4. The emergency lifting or lowering device of an elevator as claimed in claim 1, wherein said steel ropes being wound around said reeling members with a length being at least no shorter than distance between two adjacent floors.

* * * * *